US008198825B2

(12) United States Patent
Ho et al.

(10) Patent No.: US 8,198,825 B2
(45) Date of Patent: Jun. 12, 2012

(54) ILLUMINATING MODULE CAPABLE OF COMPENSATING CURRENT

(75) Inventors: Lien-Jen Ho, Taoyuan (TW); Chun-Hao Yu, Taoyuan (TW)

(73) Assignee: Darfon Lighting Corp., Neihu, Taipei (TW)

( * ) Notice: Subject to any disclaimer, the term of this patent is extended or adjusted under 35 U.S.C. 154(b) by 203 days.

(21) Appl. No.: 12/787,398

(22) Filed: May 26, 2010

(65) Prior Publication Data

US 2011/0291580 A1 Dec. 1, 2011

(51) Int. Cl.
*H05B 37/02* (2006.01)

(52) U.S. Cl. ..... 315/291; 315/224; 315/307

(58) Field of Classification Search ..... 315/209 R, 315/224–226, 239, 276, 282, 283, 291, 307, 315/308

See application file for complete search history.

(56) References Cited

U.S. PATENT DOCUMENTS

| | | | | |
|---|---|---|---|---|
| 6,326,740 | B1 * | 12/2001 | Chang et al. | 315/291 |
| 6,548,964 | B2 * | 4/2003 | Kamata et al. | 315/209 R |
| 2002/0030456 | A1 * | 3/2002 | Kim | 315/307 |
| 2010/0060200 | A1 * | 3/2010 | Newman et al. | 315/307 |
| 2011/0121752 | A1 * | 5/2011 | Newman et al. | 315/291 |

* cited by examiner

*Primary Examiner* — Tung X Le
(74) *Attorney, Agent, or Firm* — Winston Hsu; Scott Margo

(57) ABSTRACT

An illuminating module is capable of compensating current. The illuminating module can tune the light with a light modulating circuit. The illuminating module includes an illuminating unit and a compensating circuit. The illuminating unit includes a power source, a load impedance, and a level unit. The level unit has a level potential which changes with the light modulating circuit. The compensating circuit includes a first resistor, a first switch, and a judging unit. The first resistor is coupled to the power source. The first switch is coupled to the first resistor and the illuminating unit. The judging unit is coupled to the level unit and the first switch. When the level potential is less than a predetermined potential, the judging unit makes the first switch to be at the conducting state to parallel connect the first resistor and the load impedance.

5 Claims, 4 Drawing Sheets

ILLUMINATING MODULE CAPABLE OF COMPENSATING CURRENT

BACKGROUND OF THE INVENTION

1. Field of the Invention

The invention relates to an illuminating module capable of compensating current, and particularly, the invention relates to an illuminating module which can judge if the current in the silicon controlled rectifier of the light modulating circuit is insufficient and then further compensate current.

2. Description of the Prior Art

The dimmer is used for adjusting the illumination of the lamp according to the requirement of the user. However, for the case of the dimmer used in Cold Cathode Fluorescent Lamp (CCFL), the flicker occurs when the current is less then a specific value. Besides of making the user to feel uncomfortable, the life of the CCFL would be reduced when the flicker occurs frequently.

Therefore, the invention is to provide an illuminating module capable of compensating current which can judge if the current in the silicon controlled rectifier of the light modulating circuit is insufficient and then further compensate current for the light modulating circuit, so that the flicker of the tube, caused by the abnormal bouncing of the silicon controlled rectifier generated by the insufficiency of current, could be avoided.

SUMMARY OF THE INVENTION

Therefore, a scope of the invention is to provide an illuminating module capable of compensating current, and the illuminating module can tuning the light with a light modulating circuit. The illuminating module includes an illuminating unit and a compensating circuit. The illuminating unit has a potential source, a load impedance, and a level unit. The level unit has a level potential which changes with the light modulating circuit. The compensating circuit includes a first resistor, a first switch, and a judging unit. The first resistor is coupled to the potential source. The first switch is coupled to the first resistor and the illuminating unit. The judging unit is coupled to the level unit and the first switch. When the level potential is less than a predetermined potential, the judging unit makes the first switch to be at the conducting state to parallel connect the first resistor and the load impedance.

Compared to the prior art, the illuminating module capable of compensating current of the invention can detect the insufficiency of current supplied to the silicon controlled rectifier by the light modulating circuit, and then further compensate current for the light modulating circuit. Therefore, the flicker generated by the repeatedly on and off states of the silicon controlled rectifier can be avoid, wherein the rectifier would be turned off by the insufficiency of current and turned on by the triggering of the potential.

These and other features, aspects, and advantages of the present invention will become better understood with regard to the following description, appended claims, and accompanying drawings.

BRIEF DESCRIPTION OF THE APPENDED DRAWINGS

DETAILED DESCRIPTION OF THE INVENTION

Figure 1:
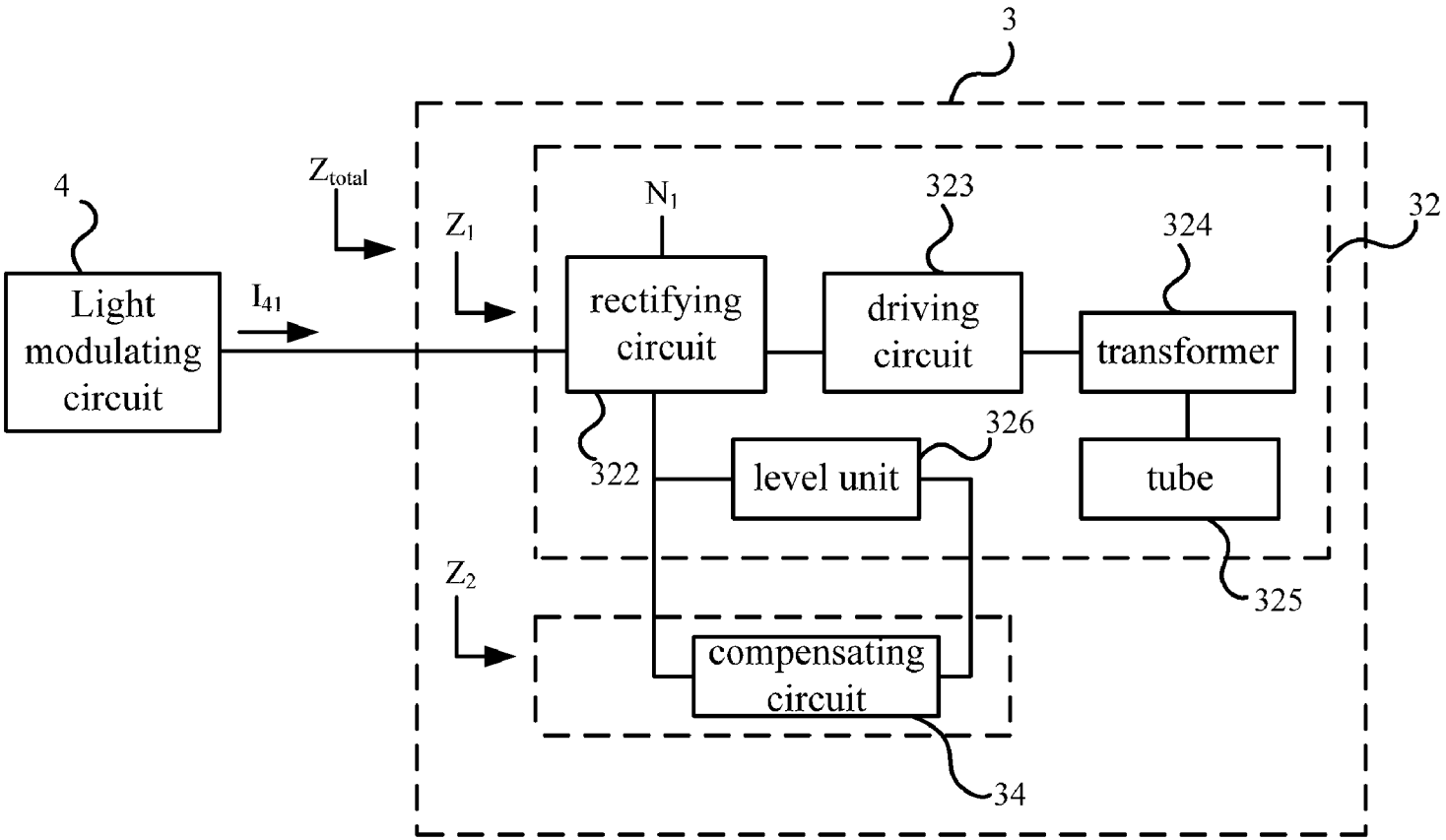
FIG. 1 is a function block diagram illustrating an illuminating module capable of compensating current according to an embodiment of the invention.

Please refer to FIG. 1. FIG. 1 is a function block diagram illustrating an illuminating module 3 capable of compensating current according to an embodiment of the invention. As shown in FIG. 1, the illuminating module 3 is connected to a light modulation circuit 4, and the illuminating module 3 can tune the light with the light modulating circuit 4. That is to say, the light modulating circuit 4 can tune the light emitting from the illuminating module 3 to control the illumination. The illuminating module 3 includes an illuminating unit 32 and a compensating circuit 34. The illuminating module 3 has an impedance $Z_{total}$. The illuminating unit 32 has an impedance $Z_1$, and the compensating circuit 34 has an impedance $Z_2$.

In the embodiment, the illuminating unit 32 includes the load impedance $Z_1$, a potential node $N_1$, a rectifying circuit 322, a driving circuit 323, a transformer 324, a tube 325, and a level unit 326.

The rectifying circuit 322 is coupled to the potential node $N_1$, the driving circuit 323, and the level unit 326. The driving circuit 323 is coupled to the transformer 324. The transformer 324 is coupled to the tube 325. The driving circuit 323 can be used for generating a Pulse Width Modulation (PWM) signal. The transformer 324 can be used for transforming the PWM signal to a sinusoidal wave.

Particularly, the tube 325 can include a Cold Cathode Fluorescence Lamp (CCFL). However, the shape, amount, and length of the CCFL included by tube 325 are not limited to a specific type but decided according to the request of the user. Besides, the compensating circuit 34 is coupled to the rectifying circuit 322 and the level unit 326.

Figure 2:
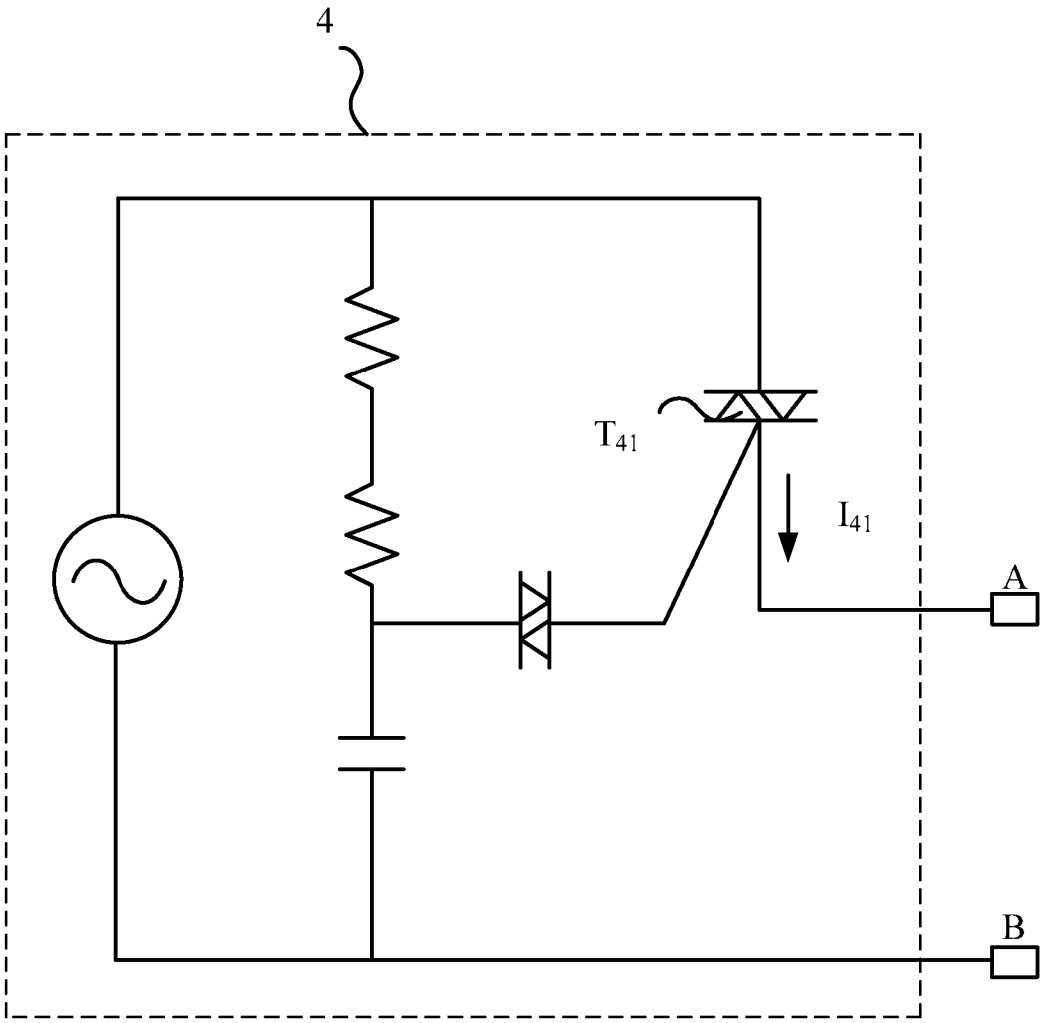
FIG. 2 is a schematic diagram illustrating the internal circuit of the light modulating circuit in FIG. 1.
Figure 3:
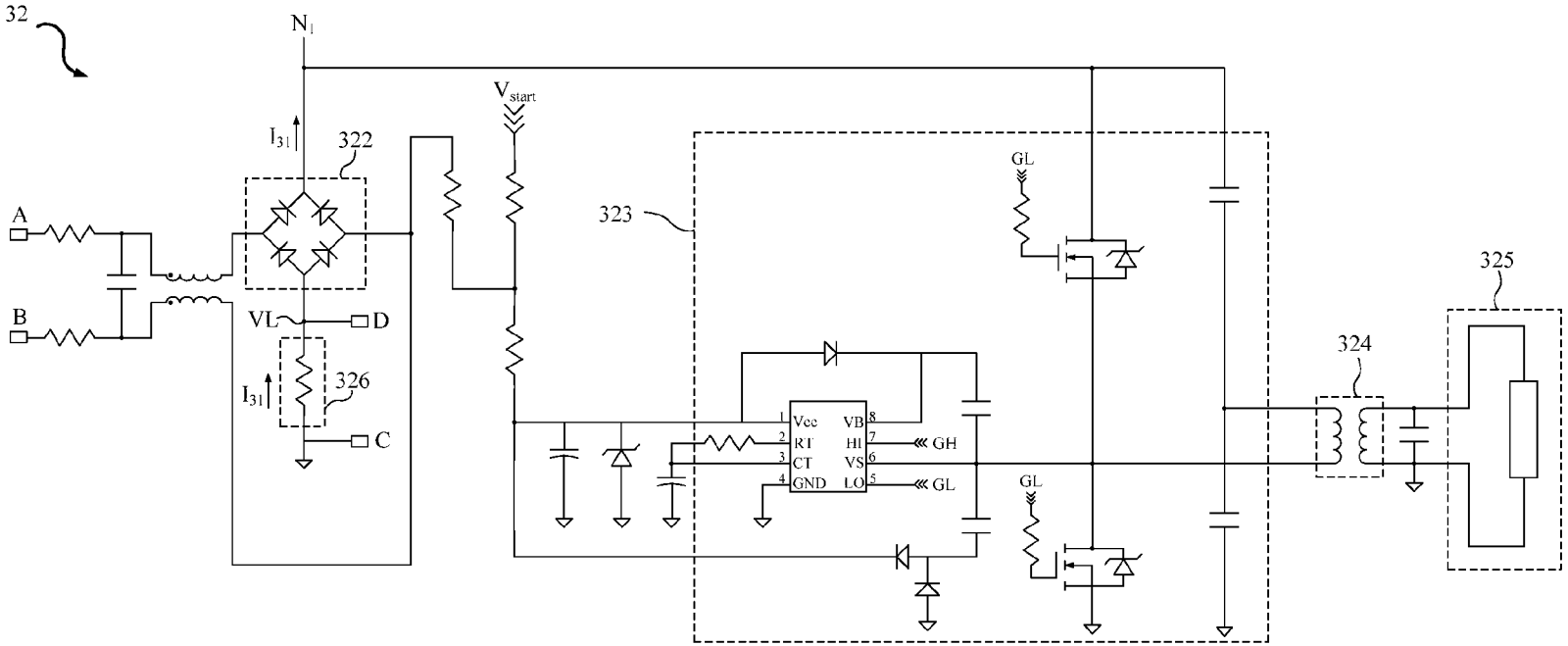
FIG. 3 is a schematic diagram illustrating the internal circuit of the illuminating unit in FIG. 1.
Figure 4:
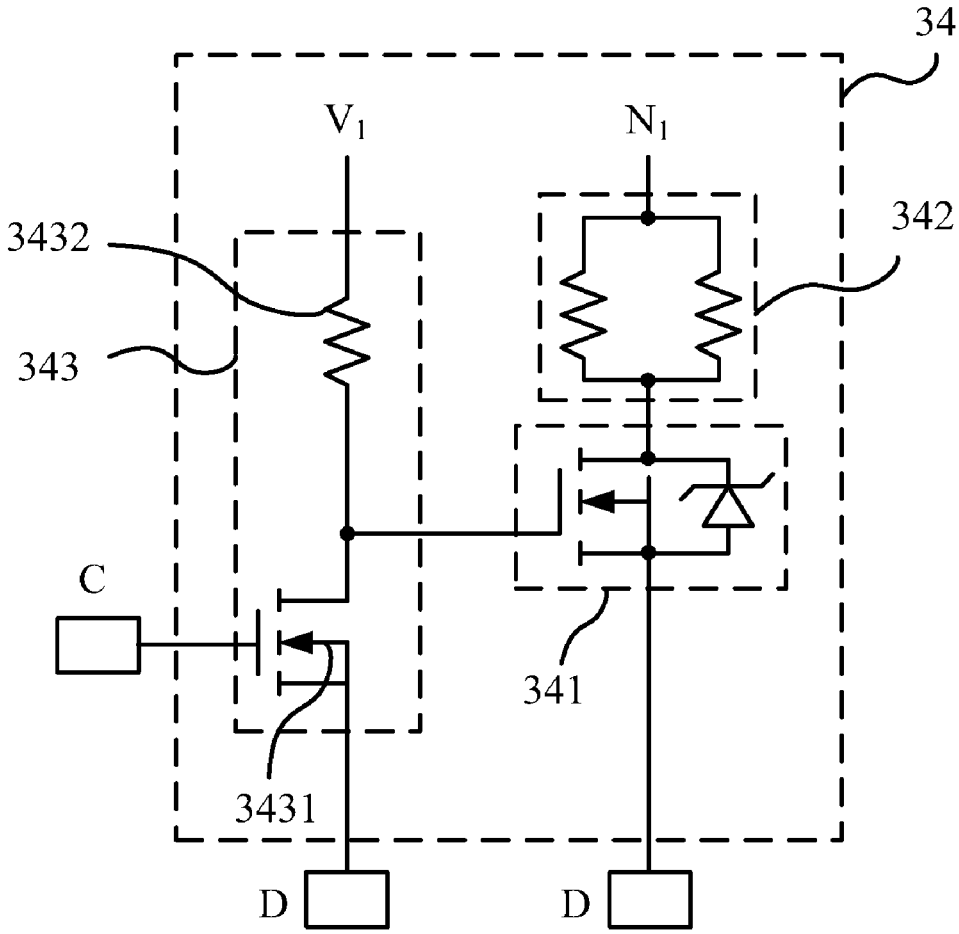
FIG. 4 is a schematic diagram illustrating the internal circuit of the compensating circuit in FIG. 1.

Please refer to FIG. 1, FIG. 2, FIG. 3, and FIG. 4. FIG. 2 is a schematic diagram illustrating the internal circuit of the light modulating circuit 4 in FIG. 1. FIG. 3 is a schematic diagram illustrating the internal circuit of the illuminating unit 32 in FIG. 1. FIG. 4 is a schematic diagram illustrating the internal circuit of the compensating circuit 34 in FIG. 1. As shown in FIG. 1, FIG. 2, FIG. 3, and FIG. 4, the light modulating circuit 4 includes an AC silicon controlled rectifier $T_{41}$, and the AC silicon controlled rectifier $T_{41}$ has a current $I_{41}$ thereon. Particularly, the points A and B in FIG. 2 are respectively connected to the points A and B in FIG. 3. The AC silicon controlled rectifier $T_{41}$ can be used for changing a conduction angle of the input to the illuminating unit 32.

The rectifying circuit 322 of the illuminating unit 32 can be, but not limited to, a bridge rectifier. The rectifying circuit 322 has a current $I_{31}$, and the current $I_{31}$ is substantially the same as the current $I_{31}$. The level unit 326 can be, but not limited to, a resistor.

In this embodiment, the compensating circuit 34 includes a first switch 341, a first resistor 342, and a judging unit 343. The first switch 341 is coupled to the first resistor 342. The first switch 341 can be, but not limited to, a MOSFET. The first resistor 342 is coupled to the potential node $N_1$. The first resistor 342 can include at least one resistor parallel connected or series connected to each other, but it is not a limitation. The purpose to parallel connect or series connect the at least one resistor included by the first resistor 342 is to disperse the thermal energy generated by the at least one resistor.

In this embodiment, the judging unit 343 is connected to the points C and D in FIG. 3 with the points C and D in FIG.

4. In other words, the judging unit 343 is coupled to the level unit 326 and the first switch 341. Besides, the judging unit 343 includes a first MOSFET 3431 and a second resistor 3432. The first MOSFET 3431 is electrically connected to the level unit 326 and the second resistor 3432. The second resistor 3432 is electrically connected to a reference power source $V_1$. Particularly, the reference power source $V_1$ can be, but not limited to, 15 volts.

The function blocks, the elements in the function blocks, and the connecting relationships between all function blocks and elements of the invention are described in detail as above. The actions in the circuit of the invention would be described in detail as following.

Please refer to FIG. 1, FIG. 2, FIG. 3, and FIG. 4. The situation that the current $I_{31}$ is greater than a predetermined value (such as 0.075 A) would be discussed firstly. The current $I_{31}$ flowing through the level unit 326 generates a level potential VL. When the current $I_{31}$ is greater than a predetermined value (such as 0.075 A), the level potential VL makes the first switch 341 to keep the off state. When the first switch 341 is at the off state, the first resistor has no influence and effect to the whole circuit. In other words, the impedance $Z_{total}$ of the illuminating module 3 is equal to the impedance $Z_1$ of the illuminating unit 32.

Afterwards, the situation that the current $I_{31}$ is less than a predetermined value would be discussed. When the current $I_{31}$ is influenced by the conduction angle of the light modulating circuit 4 to be less than 0.075 A (it should be noted that the predetermined value is not limited to 0.075 A), and then the level potential VL decreases. When the level potential VL decreases, the potential across the first MOSFET 3431 would decrease too. The first MOSFET 3431 would be turned off if the level potential VL decreases to the condition of disabling the first MOSFET 3431 from keeping the conducting state. When the first MOSFET is turn off, the first switch 341 would be at the conducting state. In other words, the first switch 341 would be turned on. Therefore, the first resistor 342 is parallel connected to the potential node $N_1$.

Please refer to FIG. 1. As shown in FIG. 1, the effect that the first resistor 342 is parallel connected to the potential nodes $N_1$ can be regarded as that the compensating circuit 34 provides the impedance $Z_2$. Therefore, the load impedance $Z_1$ of the illuminating unit 32 would be parallel connected to the compensating impedance $Z_2$. The impedance $Z_{total}$ is defined as the total impedance of the illuminating module 3, so that the impedance $Z_{total}$ is equal to the load impedance $Z_1$ parallel connected to the compensating impedance $Z_2$ at this situation. According to Ohm's law, when the potential is fixed, the decrease of the impedance causes the increase of the current, so that it is obvious that the current $I_{31}$ would increase. The increase of current $I_{31}$ enables the silicon controlled rectifier $T_{41}$ to keep at the on state, and then the bouncing and the flicker of the tube would be avoided.

Compared to the prior art, the illuminating module capable of compensating current of the invention can judge if the current in the silicon controlled rectifier of the light modulating circuit is insufficient and then further compensate current. Therefore, the abnormal actions of the silicon controlled rectifier caused by the insufficiency of current could be avoided.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An illuminating module capable of compensating current, the illuminating module being capable of tuning the light with a light modulating circuit, the illuminating module comprising:

an illuminating unit, having a load impedance, the illuminating unit comprising:
- a tube;
- a potential node; and
- a level unit, having a level potential which changes with the light modulating circuit;

a compensating circuit, comprising:
- a first resistor, coupled to the potential node;
- a first switch, coupled to the first resistor; and
- a judging unit, coupled to the level unit and the first switch, the judging unit comprising:
  - a second resistor, electrically connected to a reference power source; and
  - a first MOSFET, electrically connected to the level unit and the second resistor;

wherein when the level potential is less than a predetermined potential, the judging unit makes the first switch to be at the conducting state to parallel connect the first resistor and the load impedance.

2. The illuminating module capable of compensating current according to claim 1, wherein the illuminating unit further comprising:
- a rectification circuit, coupled to the potential node and the level unit;
- a driving circuit, coupled to the rectification circuit, the driving circuit being used for generating a pulse width modulation signal; and
- a transformer, coupled to the driving circuit and the tube.

3. The illuminating module capable of compensating current according to claim 2, wherein the tube comprises a cold cathode fluorescent lamp.

4. The illuminating module capable of compensating current according to claim 1, wherein the level unit is a resistor.

5. The illuminating module capable of compensating current according to claim 1, wherein the light modulating circuit comprises an AC silicon controlled rectifier for changing a conduction angle of the input to the illuminating unit.

* * * * *